US005667035A

United States Patent [19]

Hughes

[11] Patent Number: 5,667,035

[45] Date of Patent: Sep. 16, 1997

[54] OVERHEAD PLATFORM ELEVATION DEVICE

[76] Inventor: Douglas J. Hughes, 2936 W. Royal La. #1140, Irving, Tex. 75063

[21] Appl. No.: 545,287

[22] Filed: Oct. 19, 1995

[51] Int. Cl.[6] ..... E04G 3/00

[52] U.S. Cl. ..... 182/142; 182/82

[58] Field of Search ..... 182/142, 82, 143, 182/144, 147

[56] References Cited

U.S. PATENT DOCUMENTS

| | | | |
|---|---|---|---|
| Re. 22,069 | 4/1942 | Medenwald | 182/144 X |
| 61,835 | 2/1867 | Ingram . | |
| 796,807 | 8/1905 | Cavanagl | 182/143 |
| 2,250,965 | 7/1941 | Pritz et al. | 254/89 |
| 2,996,151 | 8/1961 | Olson | 187/3 |
| 3,951,232 | 4/1976 | Okada | 182/142 |
| 4,157,743 | 6/1979 | Masuda et al. | 182/141 |

*Primary Examiner*—Alvin C. Chin-Shue
*Attorney, Agent, or Firm*—Smith & Catlett, P.C.

[57] ABSTRACT

An overhead platform elevation device for moving objects between a lower level of a building structure and an overhead storage space is provided including a rectangular platform having a base plate and a centrally disposed supporting surface, a motor assembly, opposed pulley assemblies, a plurality of platform adjustment cables, drive cables and telescoping stabilization members. The device of the invention is self storing, having the base plate of the platform raised flush with the ceiling of the building structure when in its raised storage position.

15 Claims, 8 Drawing Sheets

OVERHEAD PLATFORM ELEVATION DEVICE

BACKGROUND OF THE INVENTION

1. Technical Field of the Invention

This invention relates to platform elevators, and more particularly, to an overhead platform elevation device for lifting objects between two points of varying height such as from a floor to an overhead attic storage space.

2. Description of Related Art

Residential buildings commonly have an overhead attic storage area accessed by a door in the ceiling hidden in a hallway or closet. These ceiling access areas may include a collapsible, pull-down hideaway staircase suspended from the frame of the opening which drops down or unfolds after the door is opened. A problem with these overhead openings, however, is that movement of heavy, large or bulky items into the areas may include a collapsible, pull-down hideaway staircase suspended from the frame of the opening which drops down or unfolds after the door is opened. A problem with these overhead openings, however, is that movement of heavy, large or bulky items into the storage area using either the stairs or a ladder, is difficult, cumbersome and unsafe. For this reason, many residential property owners or renters do not regularly utilize the attic areas. Instead, additional costs are incurred renting storage space from outside suppliers. Therefore, there is a need in the art for easier access to overhead storage and attic areas to permit safer ingress and egress of persons carrying heavy or bulky objects.

Ground level platform elevation devices for vertically raising heavy objects from lower to higher levels are well known; however, they are not readily adaptable for providing access to overhead storage areas within residential buildings. Typically, these elevation devices include a horizontal base platform attached to a mechanical or hydraulic operating unit located beneath the platform. In non-portable configurations, the operating unit may be housed below the surface, allowing the platform to rest flush with the ground or floor during storage or lower level loading.

Although there are no known prior art teachings of a solution to the aforementioned deficiency and shortcoming such as that disclosed herein, a number of prior art references relating to ground level lifting devices exist which bear some relationship to the matters discussed herein. Such prior art references are U.S. Pat. Nos. 61,835; 2,250,965; 2,996,151; and 4,157,743. Each of these references is discussed briefly below.

U.S. Pat. No. 61,835 to Ingram relates to cellar hoisting machines. Ingram discloses a lifting device having the platform supporting legs and hoisting gear assembly housed below the cellar floor. The platform is mechanically raised and lowered on parallel, vertical screw-shafts. Ingram does not, however, teach or suggest adaptation of this device for safe, efficient overhead suspension, use and storage.

U.S. Pat. No. 2,250,965 to Pritz relates to a stabilizer for elevatable platforms. Pritz discloses an improved hydraulic plunger elevatable platform for use in maintaining the platform in a horizontal plane above the floor. Pritz does not teach or suggest, however, a means for stabilizing a non-hydraulic lifting platform suspended overhead.

U.S. Pat. No. 2,996,151 to Olson discloses a dumb waiter which includes a floor mounted platform lifting device housed within a cabinet for movement of objects through the ceiling space of one level into the floor space above. In Olson, the lifting assembly is supported, operated, and stored on the floor surface of the lower level. Olson does not teach or suggest, however, an overhead means for moving objects in and out of an attic storage space.

U.S. Pat. No. 4,157,743 to Masuda et al discloses a working base elevating apparatus which includes a plurality of telescoping cylinders and pantographs. Masuda neither teaches nor suggests, however, the use of telescoping members for stabilization and movement of an overhead suspended platform lifting device.

Review of each of the foregoing references reveals no disclosure or suggestion of a lifting device such as that described and claimed herein. It would be a distinct advantage to have a self storing lifting device for moving heavy or bulky items in and out of an overhead storage area. In addition, it would be a further advantage to have an overhead elevation device that is simple and economical to manufacture, sell and install.

SUMMARY OF THE INVENTION

An overhead platform lifting device is provided including a supporting platform, a plurality of retractable poles, and a mechanical operating assembly for vertically moving the platform. In one aspect, the present invention is a device for moving objects only between a lower level and an overhead storage area such as between a residential floor and an attic. In another aspect, the present invention is a device for moving objects and people between ground and overhead levels.

According to a preferred embodiment of the present invention, an overhead lifting device is provided comprising a supporting platform, a plurality of retractable telescoping poles and a mechanical operating assembly for vertically raising and lowering the platform. In one aspect of the present invention, the platform comprises a level base plate having a centrally disposed raised supporting surface. In another aspect of the present invention, the platform is retractably suspended within a ceiling access opening such that the platform closes the opening when the device is in its raised, storage position. In another aspect of the present invention, the supporting surface of the platform is level with the floor surface of the overhead storage area.

In another aspect of the present invention, a plurality of stabilizing retractable telescoping poles having a central bore are mounted between the supporting platform and the overhead storage area. The lower ends of the poles having the narrowest central bore are attached to the supporting platform. The telescoping sections having the largest central bore extend from the ceiling area of the building structure into the storage space above, being fixably mounted on the supporting beams, joists or floor space within the storage area. In yet another aspect of the present invention, the largest telescoping sections are mounted within the perimeter of the access opening. In yet another aspect of the present invention, the largest telescoping sections are mounted outside the perimeter of the access opening. In still another aspect of the present invention, the telescoping sections are square tubes.

According to another embodiment of the present invention, the mechanical operating assembly includes an electric motor assembly having a dual direction motor and a drive shaft with two pulleys, mounted on the storage space supporting surface adjacent to said access opening. In one aspect of the present invention, the device includes opposed pulley assemblies, each having a plurality of pulleys mounted on a pulley support rod. In a preferred configuration, two pulleys on each rod are spaced adjacent to the four corners of the access opening and an third pulley on each rod is located adjacent to the proximal side of the access opening in the same plane as a pulley on the motor drive shaft.

In another aspect of the present invention, a plurality of platform adjustment cables are attached between the corner pulleys and the platform and a plurality of drive cables are attached between the drive pulleys and third pulleys on the pulley rods. Operation of the motor causes the drive cables to rotate the pulley assemblies for adjusting the position of the platform between the storage area access opening and lower level of the building.

In yet another aspect of the present invention, the adjustment cables extend through the central bore of the retractable tubes. In still another aspect of the present invention, one side of each retractable tube section has a longitudinal cable access slot for an unobstructed cable path as the telescoping tubes are retracted and extended during the raising and lowering of the platform.

In another aspect of the present invention, the lifting apparatus is self storing. In another aspect, the platform is raised and stored substantially flush with the overhead ceiling. In another aspect of the present invention, one side of the base plate is finished to match the overhead ceiling.

According to alternative embodiment of the present invention, an enclosed platform elevation device is provided for moving objects and people between two vertical levels. The elevation device includes a supporting platform, a plurality of platform rollers, a plurality of retractable cables and an overhead mechanical operation assembly disposed within a closet. In one aspect of the present invention, the platform includes a level base plate having a centrally disposed raised supporting surface defining a base plate ledge around its perimeter.

In one aspect of the present invention the rollers are mounted on the side of the raised supporting surface and the cables are attached to the top of the supporting surface. The side mounted rollers stabilize and move the platform vertically along the interior surfaces of the closet walls. In another aspect of the invention, the cables, base plate ledge and rollers are shielded from the interior cargo space.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
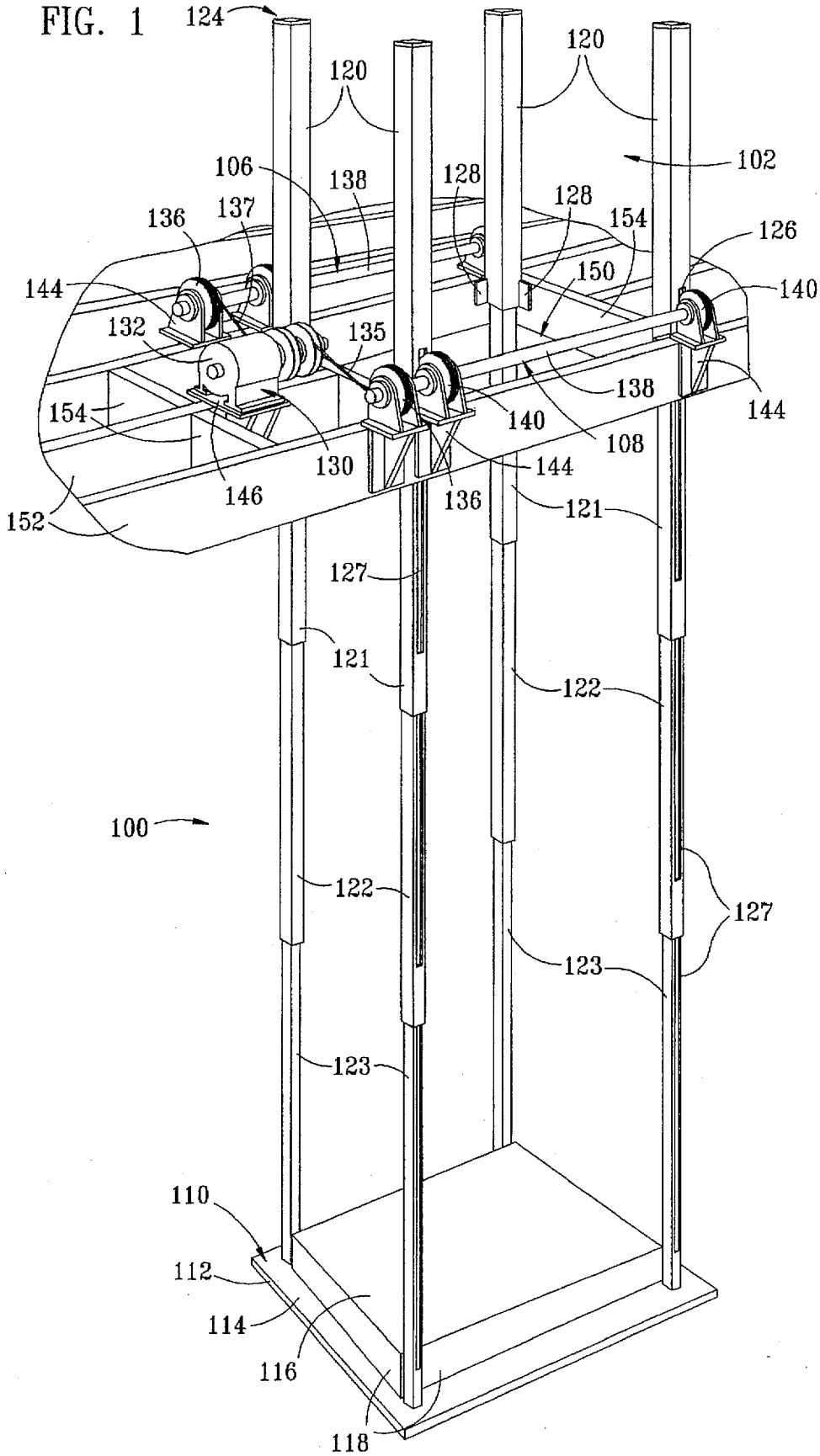
FIG. 1 is a perspective view of a preferred embodiment of the present invention in its extended position.

An overhead platform lifting device for use in moving objects between a lower level of a building structure and an overhead storage space through a ceiling access opening is shown and described. Referring to the preferred embodiment shown in its extended position in FIG. 1 and its retracted position in FIG. 2, lifting device 100 includes a platform 110, reversible motor assembly 130 and pulley assemblies 106, 108 mounted around the perimeter of access opening 150.

Figure 2:
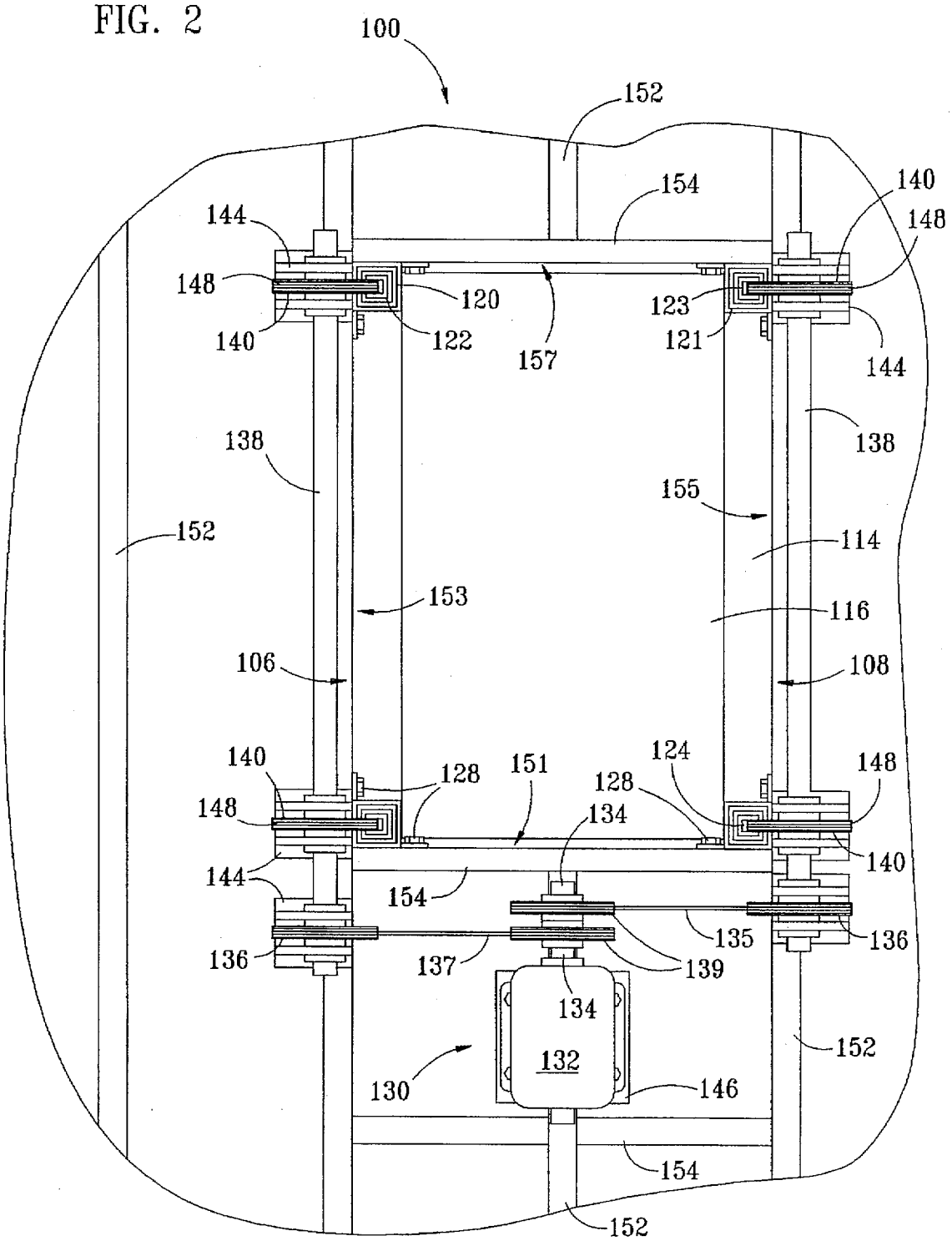
FIG. 2 is a top plan view of a preferred embodiment of the present invention in its retracted position.

The platform 110 preferably comprises a base plate 112, and a centrally disposed supporting surface 116 having sides 118 and defining base ledge 114 around the perimeter of supporting surface 116. Optionally, sides 118 may be of sufficient height such that supporting surface 116 is in the same horizontal plane as joists 152, 154 or an alternative storage space supporting surface (not shown) when platform 110 is in its raised position as shown in FIG. 2. In this design, objects may be moved more easily on and off the platform 110 without the need for bringing additional lifting aid such as ramps or dollies into storage space 102.

In its preferred embodiment, platform 110 is constructed of the aluminum. It will be understood and appreciated by those skilled in the art, however, that platform 110 may be constructed of any material of sufficient strength and weight to support the applied loads.

Reversible motor assembly 130 preferably includes a dual direction motor 132, drive shaft 134, and pulleys 139 mounted on drive shaft 134, and optional motor platform 146. Motor assembly 130 is fixably mounted within the overhead storage space 102 on joists 152, 154 or an alternative storage space supporting surface (not shown) which rests on joists 152, 154. Preferably, motor assembly 130 is mounted adjacent to proximal side 151 of the perimeter of access opening 150.

Opposed parallel pulley assemblies 106, 108 comprise a pulley support rod 138 extending the longitudinal length of the respective left and right sides 153, 155 of the access opening 150 between the proximal motor side 151 and the distal side 157. Pulleys 140 are mounted adjacent to the four corners of the perimeter of access opening 150 on pulley mounts 144. Operating pulleys 136 are mounted adjacent to the proximal side 151 of access opening 150 in the same vertical plane as the respective motor pulleys 139.

Figure 3:
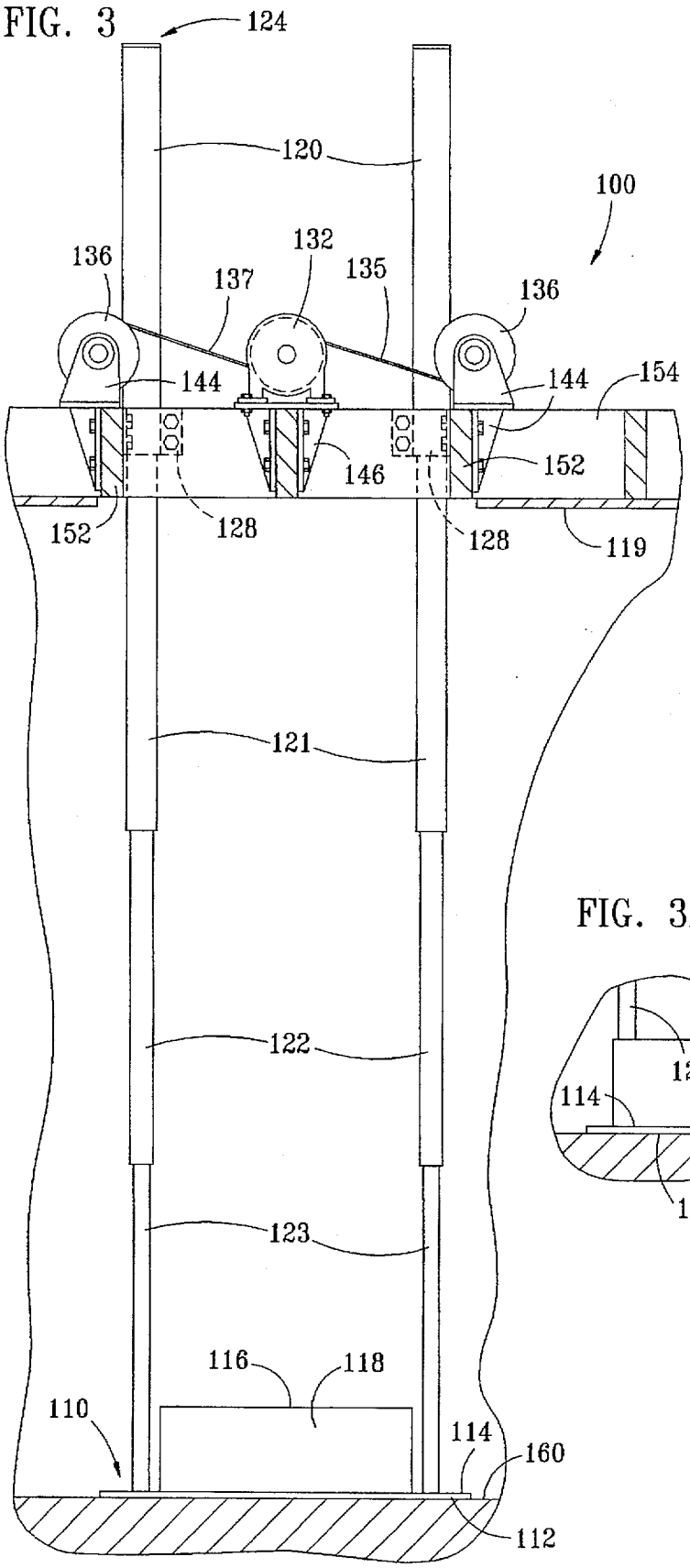
FIG. 3 is a side elevation view of a preferred embodiment of the present invention in its extended position.
Figure 5:
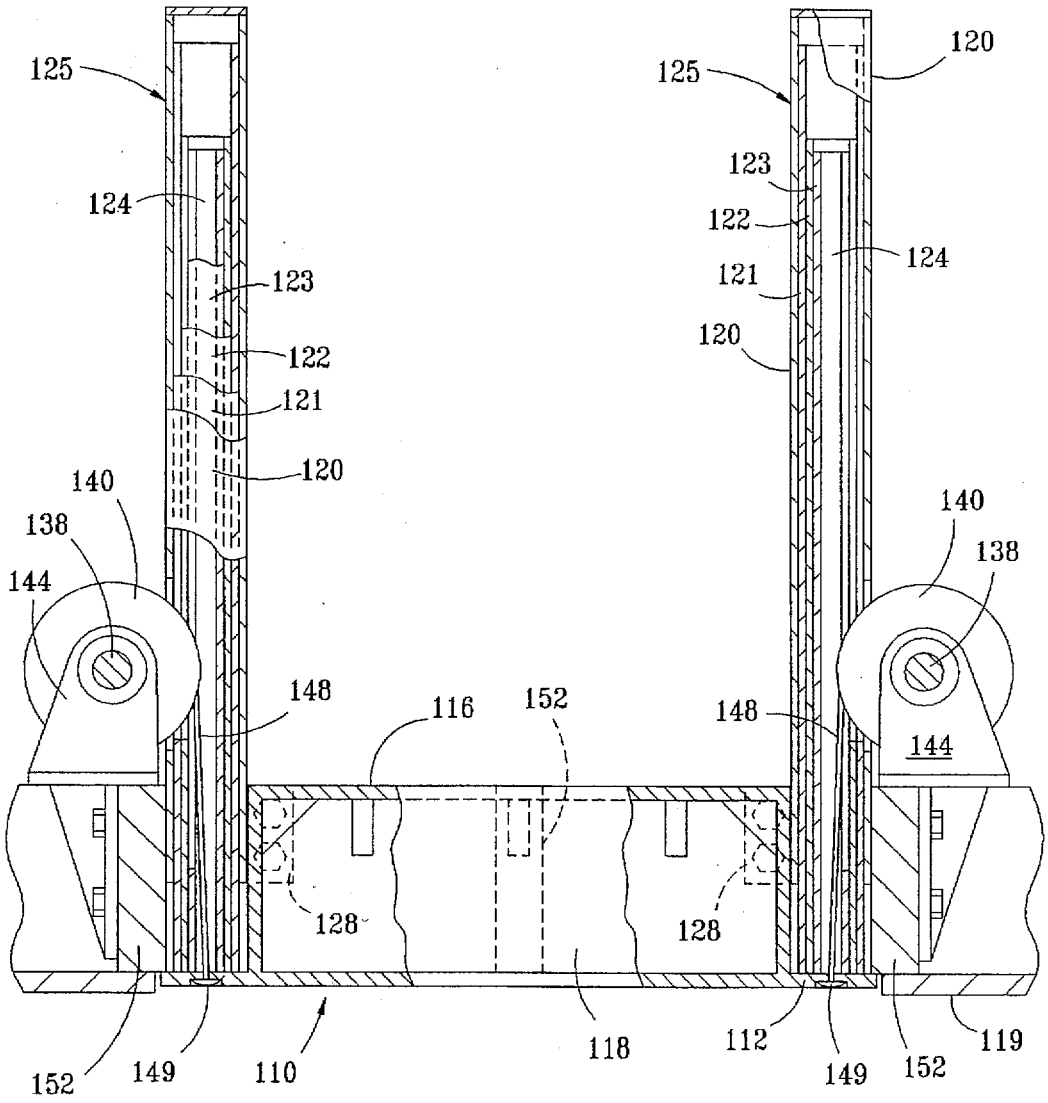
FIG. 5 is a side elevation view of a preferred embodiment of the present invention shown partially in section, in its retracted position.

As shown in FIGS. 1–3, operation cables 135, 137 interconnect motor pulleys 139 and operating pulleys 136. Referring to FIGS. 1, 2 and 5, a plurality of platform adjustment cables 148 are attached between corner pulleys 140 and platform 110. Device 100 further comprises a plurality of retractable telescoping pole assemblies 125 having a tapering central bore 124 defined by pole members 120, 121, 122, 123. Members 120 are mounted with supports 128 adjacent to the perimeter of access opening 150. Platform adjustment cables 148 extend through longitudinal cable access slots 126, 127 into central bore 124 of telescoping pole assemblies 125.

Figure 6:
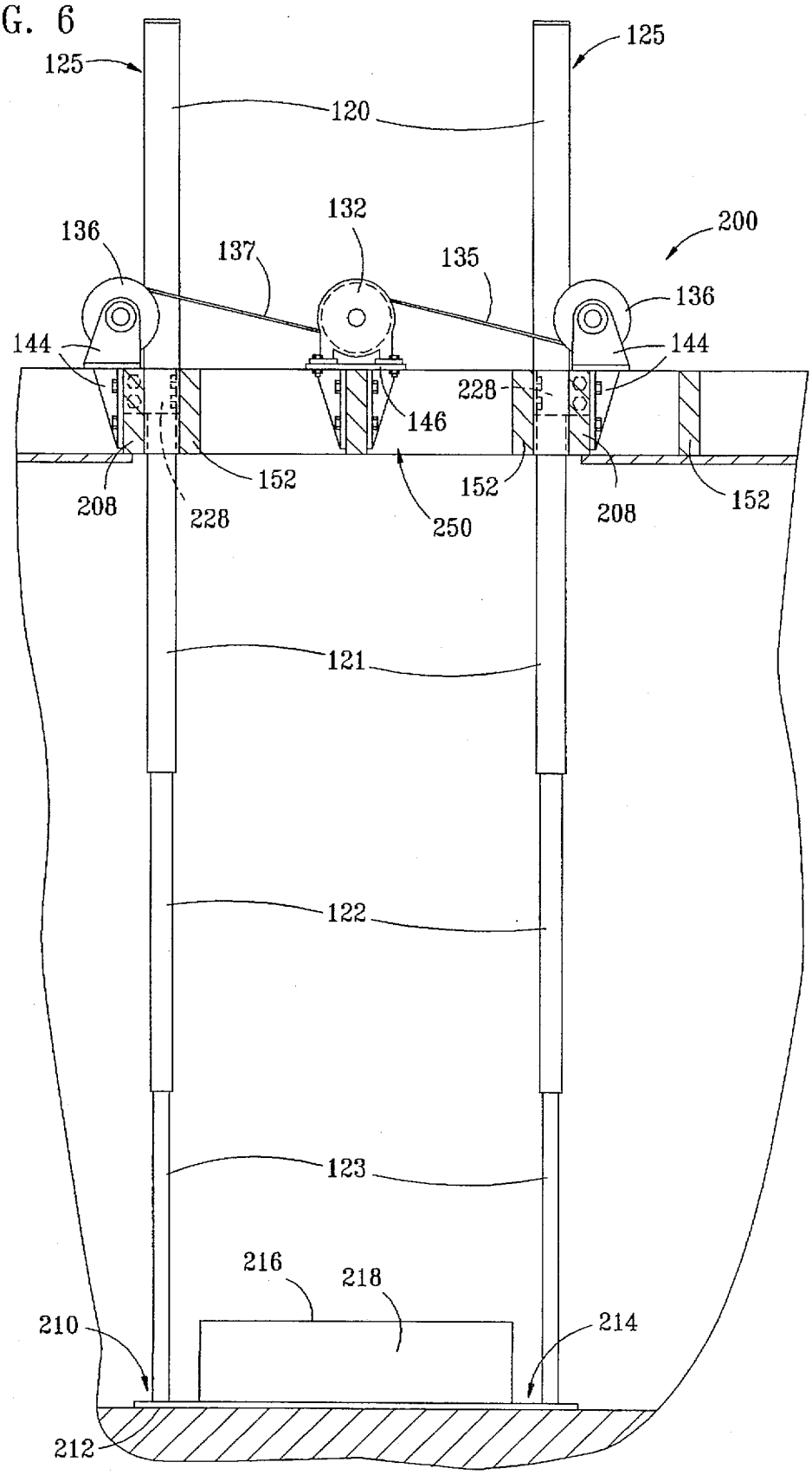
FIG. 6 is a side elevation view of another alternative embodiment of the present invention in its extended position.

It will be understood and appreciated by those skilled in the art that the present invention may be adapted to accommodate any size or shape of access opening 150. As shown in the preferred embodiments, access opening 150 is rectangular. In the embodiment as shown in FIGS. 1–5, telescoping pole assemblies 125 are mounted within the interior perimeter of access opening 150. In another embodiment, as shown in FIG. 6, telescoping pole assemblies 125 of lifting device 200 are mounted outside the perimeter of access opening 150 using alternative mounts 228 and support blocks 208. Platform 210 comprises base plate 212, base ledge 214, and centrally disposed supporting surface 216 having sides 218. In this configuration, platform 210 completely seals access opening 250 when lifting device 200 is in its fully retracted, storage position.

Figure 3A:
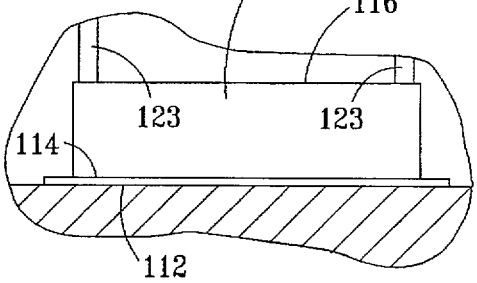
FIG. 3A is a side elevation view of an embodiment of the invention depicting an alternative arrangement of the platform and telescoping poles of the present invention.

As shown in FIGS. 1 and 3, telescoping pole assemblies 125 are preferably square tubes, wherein the members 120 comprise the largest area of central bore 124 and members 123 comprise the smallest area of central bore 124. Referring to FIGS. 3 and 5, telescoping members 123 and adjustment cables 148 are mounted to the base plate ledge 114 proximal to the corners defined by the perimeter of base plate 112 with attachment means 149. In an alternative embodiment, as shown in FIG. 3A, telescoping members 123 and adjustment cables 148 are mounted proximal to the four corners of supporting surface 116.

In its preferred embodiment, pole assemblies 125, pulley assemblies 106, 108 and cables 135, 137, and 148 are constructed of steel. It will be understood and appreciated by those skilled in the art that any material of sufficient strength to withstand the loads applied would be suitable. Telescoping pole assemblies 125 are provided as cable guides and platform stabilizers only and will not be under load. Therefore, a lightweight material such as aluminum may also be suitable.

Figure 4:
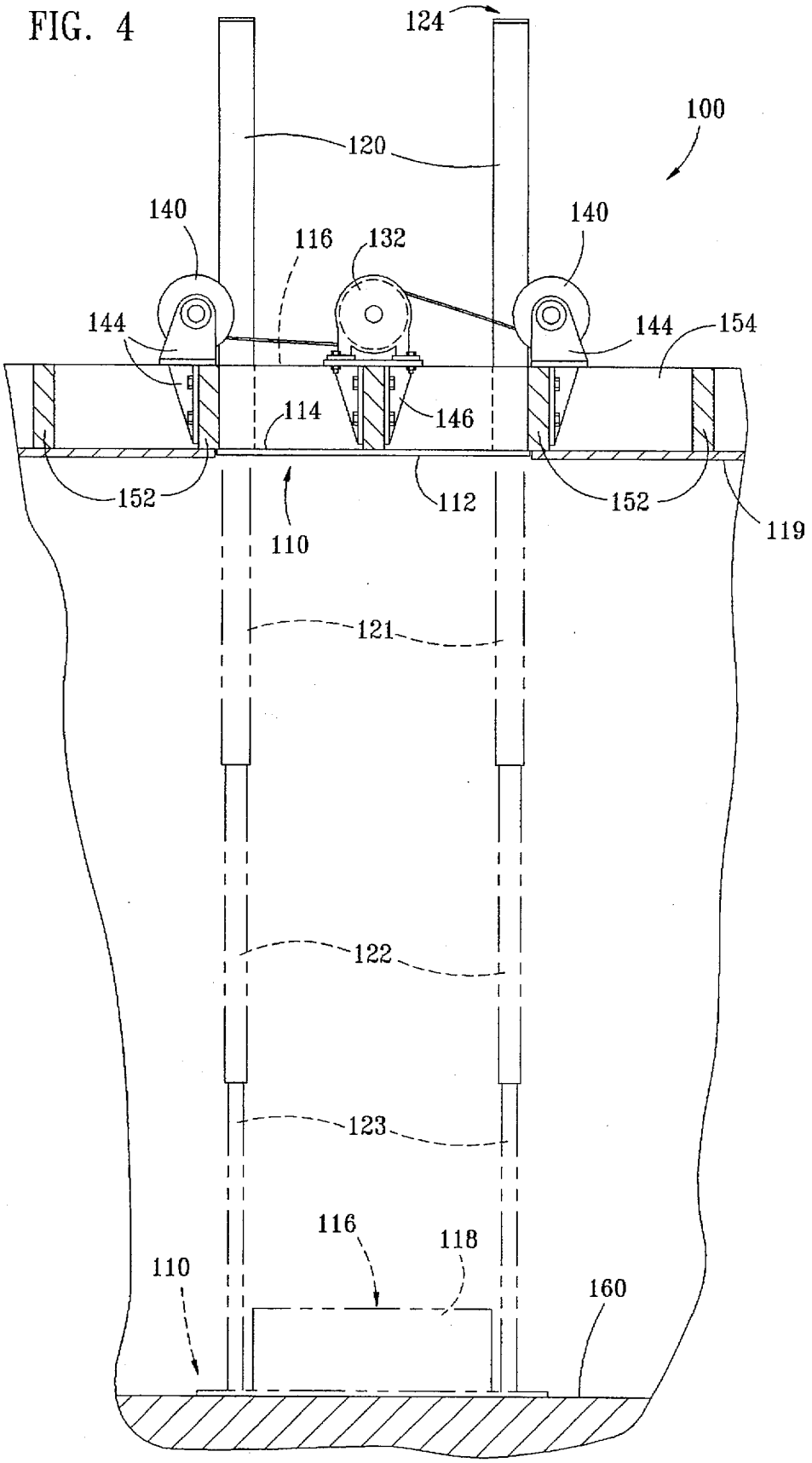
FIG. 4 is a side elevation view of a preferred embodiment of the present invention in its retracted position with the extended position shown in phantom.

Operation of the invention will now be described with reference to FIGS. 1, 2, 4 and 5. Beginning with device 100 in its raised, retracted position as shown in FIGS. 2 and 4, a power source (not shown) activates motor assembly 130. Rotation of drive shaft 134 causes cables 135, 137 to rotate pulley assemblies 106, 108 causing extension of adjustment cables 148 and pole assemblies 125 and the resultant lowering of platform 110. In its fully extended position, base plate 112 of platform 110 rests on lower level supporting surface 160.

After loading or unloading the platform, the motor assembly is again activated such that the drive shaft 134 rotates in the reverse direction causing rotation of pulley assemblies 106, 108, lifting of platform 110 by cables 148 and retraction of telescoping pole assemblies 125. In its fully retracted, self storing position, base plate 112 of platform 110 is flush with ceiling 119 of the building structure.

The platform lifting device of the invention is particularly useful when incorporated into a residential building to provide access to attic storage areas. The present invention creates a means for easily and safely accessing typically unused overhead attic storage space.

Figure 7:
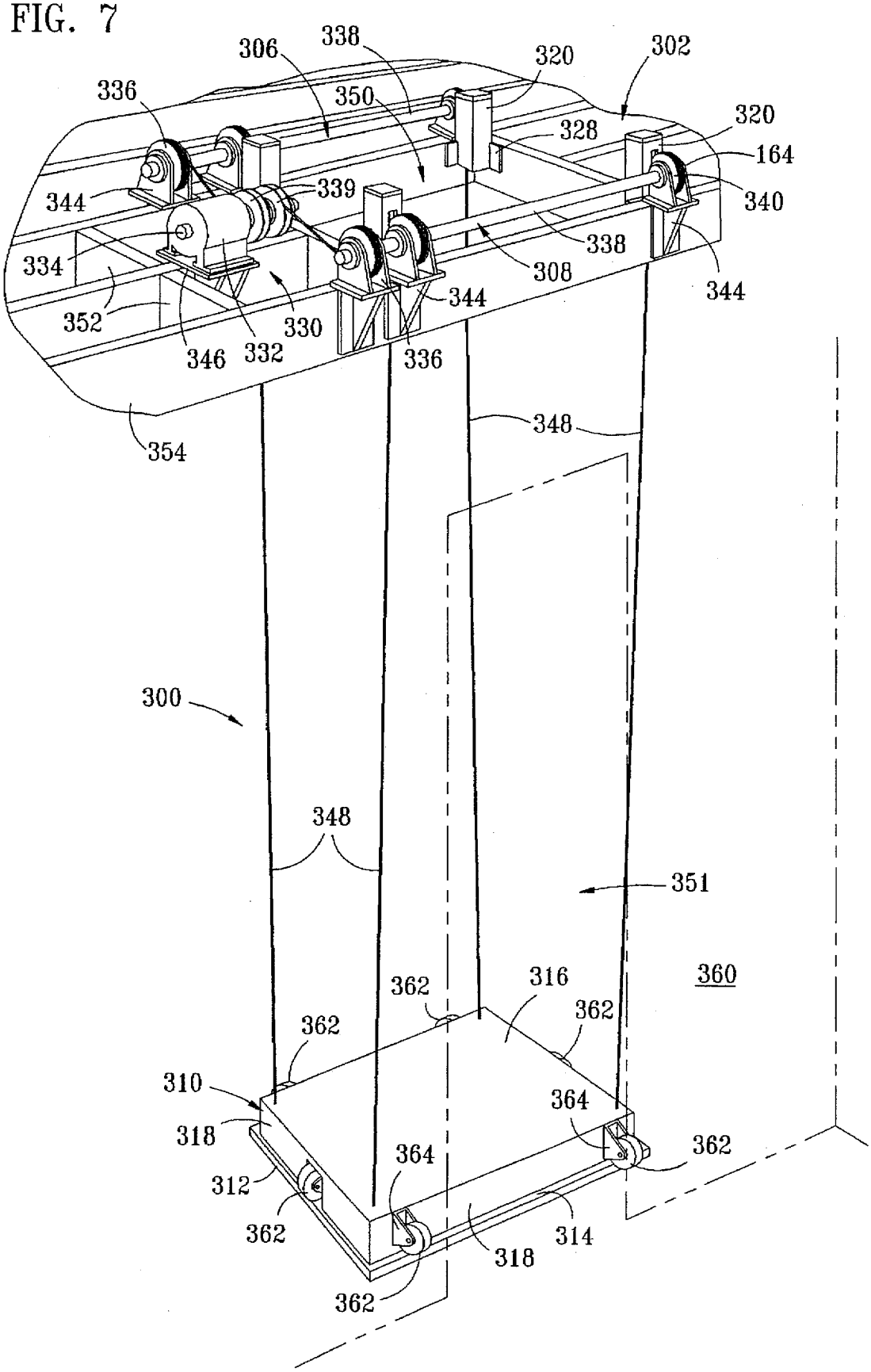
FIG. 7 is a perspective view of still another alternative embodiment of the present invention with the supporting walls of the building structure shown in phantom.
Figure 8:
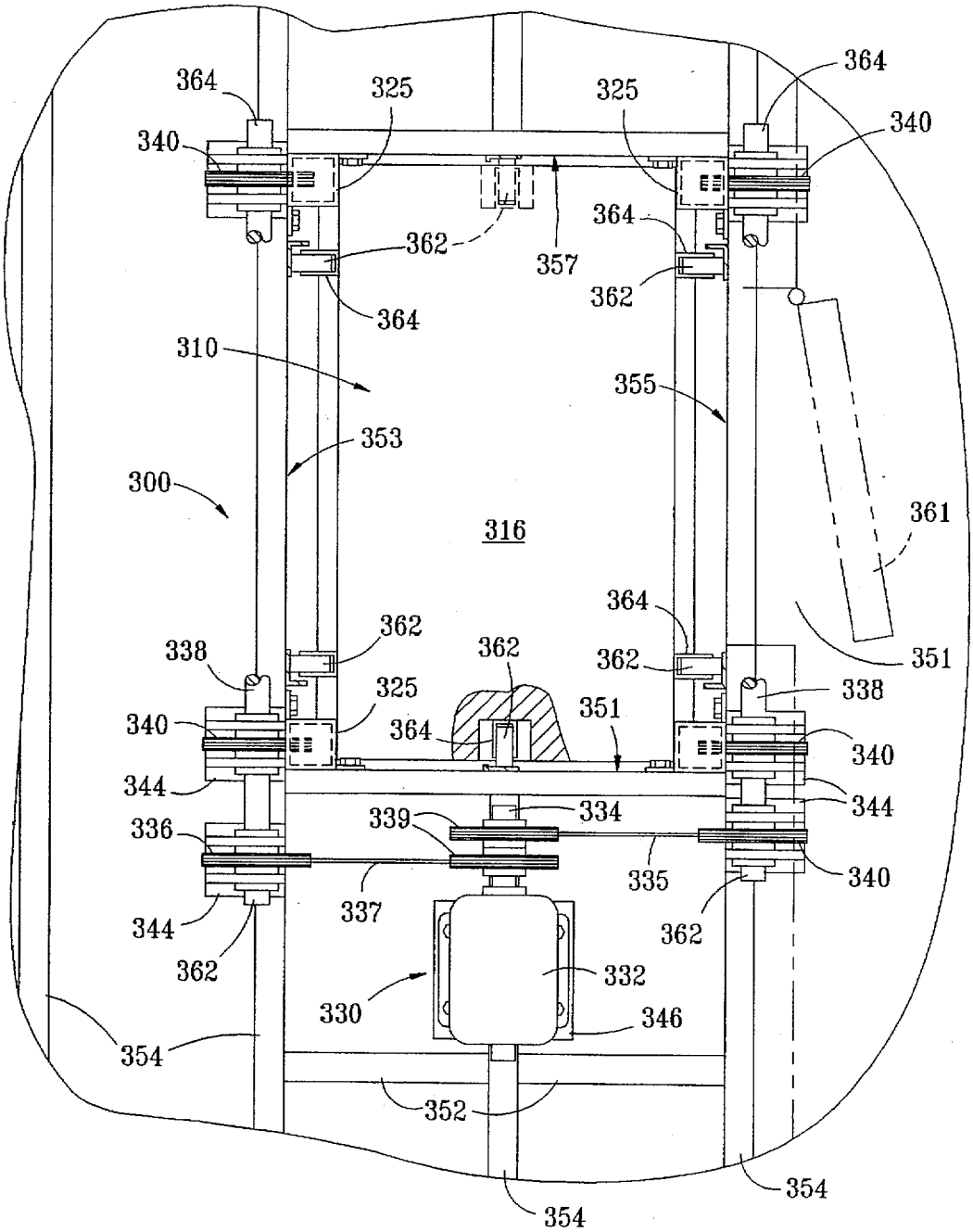
FIG. 8 is a top plan view of the alternative embodiment the present invention as shown in FIG. 7, in its retracted position.

Referring to FIGS. 7 and 8, an alternative embodiment of the present invention will now be described wherein the platform lifting device is housed within a closet space 351 of building structure 360 and may be used for moving objects and people between the lower level of building structure 360 and overhead storage space 302. Lifting device 300 is shown in its extended position in FIG. 7 and its retracted position in FIG. 8 and includes a platform 310, reversible motor assembly 330 and pulley assemblies 306, 308 mounted around the perimeter of access opening 350.

The platform 310 preferably comprises a base plate 312, a plurality of rollers 362 and roller mounts 364, and a centrally disposed supporting surface 316 having sides 318 and defining base ledge 314 around the perimeter of supporting surface 316. Sides 318 may be of sufficient height such that supporting surface 316 is in the same horizontal plane as joists 352, 354 or an alternative storage space supporting surface (not shown) when platform 310 is in its raised position as shown in FIG. 8.

Reversible motor assembly 330 includes a dual direction motor 332, drive shaft 334, and pulleys 339 mounted on drive shaft 334, and optional motor platform 346. Motor assembly 330 is fixably mounted within the overhead storage space 302 on joists 352, 354 or an alternative storage space supporting surface (not shown) adjacent to proximal side 351 of the perimeter of access opening 350.

Opposed parallel pulley assemblies 306, 308 comprise a pulley support rod 338 extending the longitudinal length of the respective left and right sides 353, 355 of the access opening 350 between the proximal motor side 351 and the distal side 357. Pulleys 340 are mounted adjacent to the four corners of the perimeter of access opening 350 on pulley mounts 344. Operating pulleys 339 are mounted adjacent to the proximal side 351 of access opening 350 in the same vertical plane as the respective motor pulleys 336.

Operation cables 335, 337 interconnect motor pulleys 339 and operating pulleys 336. A plurality of platform adjustment cables 348 are attached between corner pulleys 340 and platform 310. Device 300 further comprises a plurality of optional cable guards 325 mounted on the perimeter of access opening 350.

Operation of the invention will now be described with reference to FIGS. 7 and 8. Beginning with device 300 in its lower, extended position as shown in FIG. 7, the user enters the lifting device through access door 361 and uses a power source (not shown) to activate motor assembly 330. Rotation of drive shaft 334 causes cables 335, 337 to rotate pulley assemblies 306, 308 causing adjustment cables 348 to wind on pulleys 336, thereby raising platform 310 toward access opening 350. Side rollers 364 move along the interior surface (not shown) of the closet area to help stabilize platform 310 in a horizontal position. After loading or unloading the platform 310, the motor assembly 330 is again activated such that the drive shaft 134 rotates in the reverse direction causing rotation of pulley assemblies 106, 108, and lowering of platform 310 by cables 348.

It will be understood and appreciated by those skilled in the art that the present invention may be used in conjunction with standard collapsible attic staircases, and adapted for use in alternative areas such as a residential garage or commercial building. Optional devices, such as a load limiting device, manual stop switch, key lock, reversible clutch, or child proof electrical switch may be added to the invention to decrease the risks associated with misuse.

It is thus believed that the operation and construction of the present invention will be apparent from the foregoing description. While the device shown and described has been characterized as being preferred, it will be readily apparent that various changes and modifications could be made therein without departing from the spirit and scope of the invention as defined in the following claims.

What is claimed is:

1. A platform elevation device in combination with an overhead storage space with an access opening in the ceiling of a building structure for moving objects between a lower level of the building structure and a supporting surface of the storage space, comprising:

a rectangular platform having a base plate and a centrally disposed supporting surface;

a motor assembly having a dual direction motor and a drive shaft with two pulleys, wherein said motor assembly is mounted on the storage space supporting surface adjacent to a proximal side of said access opening;

opposed left and right pulley assemblies, each having three pulleys mounted on a pulley support rod extending along a longitudinal length of respective left and right sides of the access opening between the proximal side and opposing distal side, wherein two pulleys on each rod are spaced adjacent to a respective one of four corners of the access opening and the third pulley on each rod is located adjacent to the proximal side of the access opening in the same plane as a pulley on the motor drive shaft;

a plurality of platform adjustment cables, each cable having a first end attached to a respective pulley adjacent one of said corners and a second end attached to the platform; and left and right drive cables, each cable having a first end attached to one drive shaft pulley and a second end attached to the third pulley on the respective left and right pulley assemblies;

wherein operation of said motor causes the drive cables to rotate the pulley assemblies for adjusting the position of the platform between the storage space access opening and lower level of the building.

2. The platform elevation device of claim 1, further comprising a plurality of telescoping members having a central bore, wherein said members are mounted between the platform and storage space such that each platform adjustment cable extends through the central bore of a telescoping member.

3. The platform elevation device of claim 2, wherein the telescoping members are square tubes.

4. The platform elevation device of claim 2, wherein each telescoping member further comprises a plurality of member sections, wherein rotation of the pulley assemblies to raise the platform collapses the telescoping members by sliding the member sections having smaller central bores into the larger bores of the adjacent member sections.

5. The platform elevation device of claim 4, wherein each member section includes a longitudinal cable access slot.

6. The platform elevation device of claim 4, wherein the member sections having the largest central bores are mounted inside the perimeter of the access opening.

7. The platform elevation device of claim 4, wherein the member sections having the largest central bores are mounted outside the perimeter of the access opening.

8. The platform elevation device of claim 4, wherein the adjustment cables and member sections having the smallest central bores are attached the platform supporting surface.

9. The platform elevation device of claim 4, wherein the adjustment cables and member sections having the smallest central bores are attached to the base plate.

10. The platform elevation device of claim 1, wherein the base plate is flush with the ceiling when the platform is in its raised storage position.

11. The platform elevation device of claim 1, wherein the platform supporting surface is in the same horizontal plane as the storage space supporting surface when the platform is in its raised unloading position.

12. An enclosed platform elevation device in combination with an overhead storage space with an access opening in the ceiling of a building structure for moving objects and people between a lower level of the building structure and a supporting surface of the storage space, comprising:

a rectangular platform having a base plate, four sides, a raised supporting surface, and a plurality of rollers on the four sides;

a motor assembly having a dual direction motor and a drive shaft with two pulleys, wherein said motor assembly is mounted on the storage space supporting surface adjacent to a proximal side of said access opening;

opposed left and right pulley assemblies, each having three pulleys mounted on a pulley support rod extending along a longitudinal length of respective left and right sides of the access opening between the proximal side and opposing distal side, wherein two pulleys on each rod are spaced adjacent to a respective one of four corners of the access opening and the third pulley on each rod is located adjacent to the proximal side of the access opening in the same plane as a pulley on the motor drive shaft;

a plurality of platform adjustment cables, each cable having a first end attached to a respective pulley adjacent one of said corners and a second end attached to the platform; and left and right drive cables, each cable having a first end attached to one drive shaft pulley and a second end attached to the third pulley on the respective left and right pulley assemblies;

wherein operation of said motor causes the drive cables to rotate the pulley assemblies for adjusting the position of the platform between the storage space access opening and lower level of the building.

13. The platform elevation device of claim 12, wherein the device is enclosed in a closet having four walls and a door.

14. The platform elevation device of claim 13, wherein the platform rollers glide along the closed walls during adjustment of the position of the platform.

15. The platform elevation device of claim 12, further comprising a plurality of telescoping members having a central bore, wherein said members are mounted between the platform and storage space such that each adjustment cable extends through the central bore of a telescoping member.

* * * * *